US009141130B2

(12) United States Patent
Ellison

(10) Patent No.: US 9,141,130 B2
(45) Date of Patent: Sep. 22, 2015

(54) RATCHET AND LATCH MECHANISMS

(75) Inventor: Stuart James Ellison, Aberdeen (GB)

(73) Assignee: AKER SUBSEA LIMITED, Berkshire (GB)

( * ) Notice: Subject to any disclaimer, the term of this patent is extended or adjusted under 35 U.S.C. 154(b) by 128 days.

(21) Appl. No.: 13/817,565

(22) PCT Filed: Aug. 22, 2011

(86) PCT No.: PCT/GB2011/001253

§ 371 (c)(1),
(2), (4) Date: Feb. 19, 2013

(87) PCT Pub. No.: WO2012/025715

PCT Pub. Date: Mar. 1, 2012

(65) Prior Publication Data

US 2013/0146296 A1 Jun. 13, 2013

(30) Foreign Application Priority Data

Aug. 23, 2010 (GB) ..... 1014087.9

(51) Int. Cl.
*E21B 7/12* (2006.01)
*G05G 5/06* (2006.01)
(Continued)

(52) U.S. Cl.
CPC ..... *G05G 5/06* (2013.01); *E21B 33/038* (2013.01); *E21B 33/043* (2013.01); *Y10T 74/20636* (2015.01); *Y10T 403/32434* (2015.01)

(58) Field of Classification Search
CPC ..... E21B 33/038; E21B 33/043
USPC ..... 166/338, 341, 360, 368, 378
See application file for complete search history.

(56) References Cited

U.S. PATENT DOCUMENTS 3,542,125 A * 11/1970 Sizer ..... 166/340
4,403,523 A * 9/1983 Seger ..... 74/128
(Continued)

FOREIGN PATENT DOCUMENTS

CN 201448083 U 5/2010
CN 201448086 U 5/2010
(Continued)

OTHER PUBLICATIONS

International Search Report for PCT/GB2011/001253, mailed Dec. 12, 2012.
(Continued)

*Primary Examiner* — Matthew Buck
*Assistant Examiner* — Aaron Lembo
(74) *Attorney, Agent, or Firm* — Nixon & Vanderhye P.C.

(57) ABSTRACT

A device for the application of a preload between a subsea wellhead and a conductor housing comprises an activating member (1), a support housing (2), a locking member (3), end means (9) for securing the support housing relative to the well-head. Movement of the activating member causes an inclined lateral movement of the locking member. The activating member carries a ratchet (7) comprising a multiplicity of serrations which have a regular pitch in the activating direction and the support housing (1, 2) cames at least two latches (19, 20) which allow the relative movement and can engage the ratchet to inhibit movement reverse to the activating direction. The discrete locking positions provided by one of the latches are positionally out of phase with the discrete locking positions provided by the other latch or latches. A support member (16) is positioned to be moved laterally in response to movement of the activating member and to support the locking member (3) against the engagement zone (18) of the datum member (2).

10 Claims, 1 Drawing Sheet

(51) Int. Cl.
*E21B 33/038* (2006.01)
*E21B 33/043* (2006.01)

(56) References Cited

U.S. PATENT DOCUMENTS

| | | | | | |
|---|---|---|---|---|---|
| 4,474,236 | A * | 10/1984 | Kellett | 166/250.08 |
| 4,681,166 | A * | 7/1987 | Cuiper | 166/345 |
| 4,788,751 | A * | 12/1988 | Shely et al. | 24/16 PB |
| 4,836,288 | A * | 6/1989 | Wester | 166/348 |
| 5,026,097 | A * | 6/1991 | Reimert | 285/123.4 |
| 5,316,089 | A * | 5/1994 | Fernandez | 175/7 |
| 5,439,061 | A * | 8/1995 | Brammer et al. | 166/368 |
| 5,515,917 | A * | 5/1996 | Watkins et al. | 166/208 |
| 5,620,052 | A * | 4/1997 | Turner | 166/348 |
| 5,984,008 | A * | 11/1999 | Lang et al. | 166/208 |
| 6,550,537 | B1 | 4/2003 | Alvarez et al. | |
| 6,598,673 | B1 | 7/2003 | Hosie et al. | |
| 6,968,618 | B2 * | 11/2005 | Cook et al. | 29/890.14 |
| 7,025,145 | B2 | 4/2006 | Emmerson | |
| 7,216,699 | B2 * | 5/2007 | Nelson et al. | 166/77.51 |
| 7,357,188 | B1 * | 4/2008 | Cook et al. | 166/380 |
| 7,360,594 | B2 * | 4/2008 | Giroux et al. | 166/242.6 |
| 7,913,767 | B2 * | 3/2011 | Larson et al. | 166/380 |
| 8,312,933 | B2 * | 11/2012 | Larson et al. | 166/380 |
| 2003/0234109 | A1 | 12/2003 | Marroquin et al. | |
| 2004/0163816 | A1 | 8/2004 | Nelson et al. | |
| 2004/0168810 | A1 | 9/2004 | Emmerson | |
| 2005/0146137 | A1 | 7/2005 | Davidson et al. | |
| 2007/0267197 | A1 | 11/2007 | Pallini et al. | |
| 2007/0277983 | A1 | 12/2007 | Spiering et al. | |
| 2012/0145405 | A1 * | 6/2012 | Vanderford et al. | 166/341 |
| 2014/0202710 | A1 * | 7/2014 | Hales et al. | 166/377 |

FOREIGN PATENT DOCUMENTS

| | | |
|---|---|---|
| GB | 2 393 990 | 2/2005 |
| WO | 2010/081621 A2 | 7/2010 |
| WO | 2010/099269 A1 | 9/2010 |

OTHER PUBLICATIONS

Written Opinion for PCT/GB2011/001253, mailed Dec. 12, 2012.
Search Report dated Nov. 1, 2010 in GB 1014087.9.
Search Report dated Nov. 12, 2010 in GB 1014087.9.
Office Action dated Dec. 24, 2014 in CN 201180040610.9 with English translation.

* cited by examiner

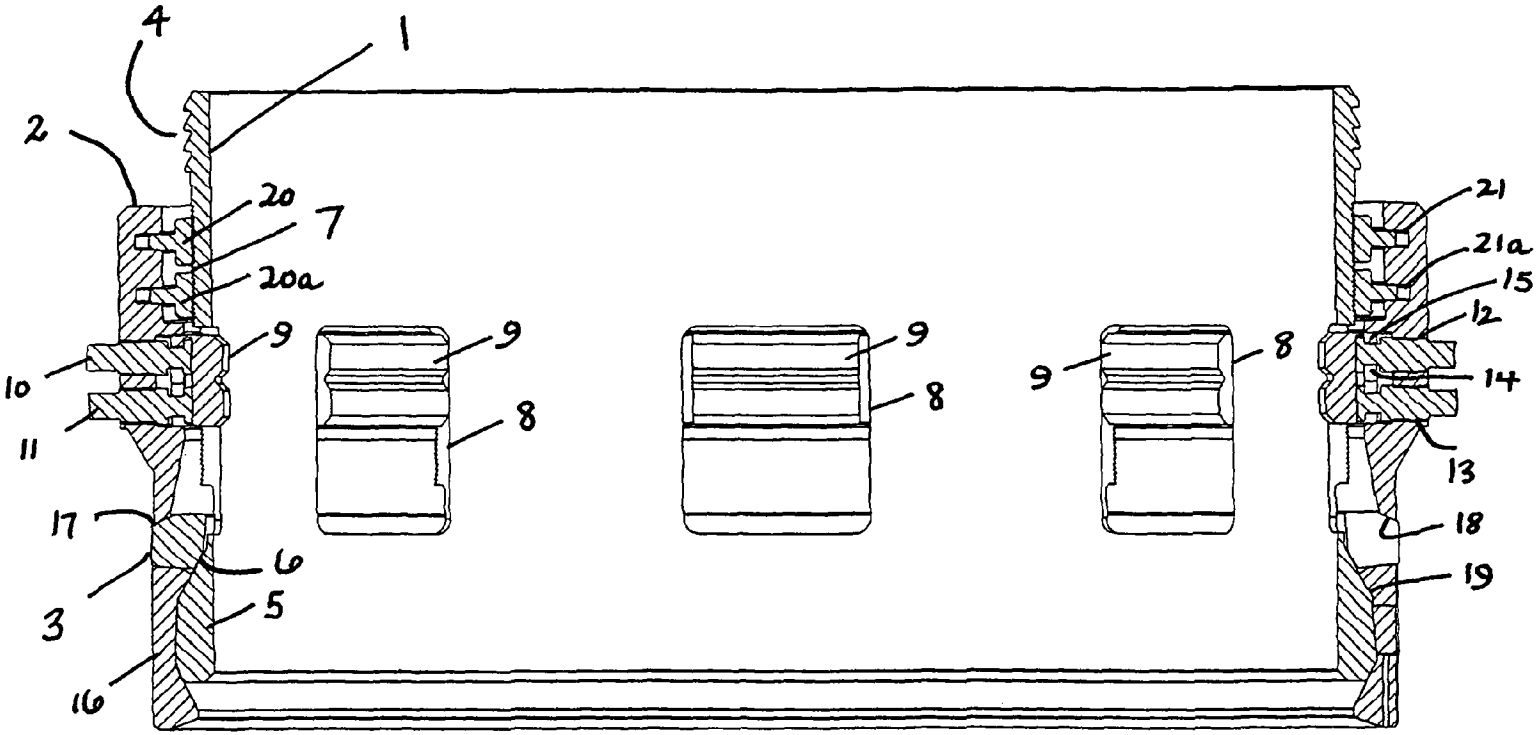
21
21a
15
12
14
13
18
19
8
9
9
8
9
8
1
20
7
20a
9
6
5
4
2
10
11
17
3
16

RATCHET AND LATCH MECHANISMS

This application is the U.S. national phase of International Application No. PCT/GB2011/001253 filed 22 Aug. 2011 which designated the U.S. and claims priority to GB 1014087.9 filed 23 Aug. 2010, the entire contents of each of which are hereby incorporated by reference.

TECHNICAL FIELD

This invention in one aspect relates to ratchet and latch mechanisms and more particularly to a device which includes a ratchet and latch mechanism and is intended for the application of a preload between two members.

For convenience a specific example of the invention will be described in the context of a device for the application of a preload between inner and outer members constituted by a subsea wellhead and a conductor housing. One example of the state of the art in relation to such devices is provided by our patents Nos. GB-2393990 and U.S. Pat. No. 7,025,145. In those patents there is an explanation of the need for the application of a preload between a wellhead and the conductor housing, i.e. for the reduction of fatigue damage.

BACKGROUND

In this and other contexts a ratchet may be engaged by a latch to provide a multiplicity of possible settings of a position of one member that carries the ratchet relative to another member which carries the latch. An ordinary ratchet and latch provides one-directional travel of one component past another. The latch may be sprung so that its profile engages discrete positions of the profile of the ratchet. Movement in the reverse direction is prevented by the locking engagement of the two profiles. The backlash of the system is determined by the pitch of the discrete locking positions of the engagement profile between the ratchet and the latch. It is, therefore, possible for the moving part of the system to come to rest within an infinitesimally small distance from which it can engage with a discrete locking position of the fixed component. From this position, there is nothing to prevent a reversal of travel up to the previous discrete locking position, which is approximately one pitch away from the desired resting position. It is, therefore, advantageous to minimize the backlash of the system such that reverse movement is efficiently reduced.

BRIEF SUMMARY

In one example, a mechanism includes first and second members which are relatively moveable in an activating direction, one of the members carrying a ratchet comprising a multiplicity of serrations which have a regular pitch in the activating direction and the other of the members carrying at least two latches which allow the relative movement and can engage the ratchet to inhibit movement reverse to the activating direction, the latches each providing a respective multiplicity of discrete locking positions spaced in the activating direction for the ratchet and being positioned and arranged so that the discrete locking positions provided by one of the latches are positionally out of phase with the discrete locking positions provided by the other latch or latches.

Each latch may comprise a multiplicity of serrations spaced in the activating direction. The pitch between the latches is preferably equivalent to $(Z*p)+(p/n)$, in which p is the pitch of the discrete locking positions, Z is any integer, and n is the number of distinct latches.

The example embodiment also provides a device for the application of a preload between a subsea wellhead and a conductor housing, comprising an activating member, a support member, a locking member, and means for securing the support member relative to the wellhead, the activating member being moveable in an activating direction relative to the support member, the activating member and the support member including surfaces which engage the locking member so as to cause, in response to movement of the activating member, an inclined movement of the locking member, said inclined movement having a component parallel to the activating direction which is substantially smaller than the movement of the activating member in that direction. One of the activating and support members carries a ratchet comprising a multiplicity of serrations which have a regular pitch in the activating direction and the other of the activating and support members carries at least two latches which allow the relative movement and can engage the ratchet to inhibit movement reverse to the activating direction, the latches each providing a respective multiplicity of discrete locking positions spaced in the activating direction for the ratchet and being positioned and arranged so that the discrete locking positions provided by one of the latches are positionally out of phase with the discrete locking positions provided by the other latch or latches.

One example embodiment will be described with reference to the accompanying drawing.

BRIEF DESCRIPTION OF THE DRAWING

The single FIG. 1 illustrates one embodiment of a mechanism for pre-loading a conductor housing relative to a subsea wellhead.

DETAILED DESCRIPTION

The mechanism shown in FIG. 1 is primarily intended for the application of a pre-load to a conductor housing (not shown) relative to a subsea wellhead (not shown) which is disposed at least partly within the conductor housing. Such wellhead and housing have generally cylindrical forms and are in use disposed normally disposed upright, their principal axes being vertical.

As is mentioned in the aforementioned patents, it is desirable to apply a preload between the conductor housing and the wellhead in order to reduce the susceptibility of the assembly of the conductor housing and wellhead to fatigue damage due to repetitive bending forces to which the assembly is subjected.

Three important components of the mechanism shown in FIG. 1 are an activating member 1, in this example having an annular form, a support housing 2, which also in this example has an annular form, and a locking member 3, which is this example is a laterally expansible ring such as a split ring. As will be described below, the support housing 2 acts as a datum member which is secured to one of the members (in this example the wellhead housing) between which the pre-load is to be applied. The activating member or ring 1 is moved relative to the support housing 2, in this example in an upward axial direction, and the locking ring 3 is slidingly moved by virtue of the engagement zones on the activating member 1 and the support housing 2 laterally obliquely, i.e. both radially and vertically. The locking member or ring 3 slidingly engages the other of the two members (i.e. the conductor housing) between which the pre-load is to be applied and the vertical component of the movement of the locking member 3 stresses the said other member, which preferably has a slot (and more particularly an annular slot) for reception of the locking member 3.

More particularly the wellhead is disposed inside the activating member 1 and the support housing 2 may be landed on the conductor housing. Neither the conductor housing nor the wellhead are shown in the drawing; the relationship between the mechanism shown in FIG. 1, the conductor housing and the wellhead generally corresponds to that shown for the tensioning mechanism described in GB-2393900 and U.S. Pat. No. 7,025,145.

At its upper end the activating ring 1 has an external profile 4 which is adapted for engagement by a suitable tool which can thereby pull up the activating ring. The profile in this example comprises annular serrations.

At its lower end the activating member 1 is formed as an enlarged ring 5 of which the upper part 6 of its outer surface is an engagement zone which tapers inwardly at a selected (small) acute angle relative to the upward (activating) direction.

Over most of its height between the profile 4 and the lower ring 5 the activating member carries, and is preferably integrally formed as, a ratchet 7, in this example consisting of a multiplicity of annular serrations evenly spaced in the activating (vertical) direction.

At circumferentially spaced intervals the activating ring 1 has windows 8, which are generally upright oblongs. These windows allow access through the activating ring for locking means, in this example constituted by locking dogs 9, to engage a suitable profile (particularly a plurality of axially spaced annular grooves not shown) on the outside of the 'inner' member (i.e. the body of the wellhead).

The locking dogs 9 are mounted on the support housing 1. The dogs 9 can be moved into engagement with the inner member by means of a screw drive. In this example the screw drive comprises for each dog 9 a pair of screws 10, 11 which are disposed in radially oriented threaded bores 12 and 13 respectively in the support housing 2. These screws may be operated by any suitable means, for example by a suitable tool of a remotely operated vehicle (ROV).

Each locking dog in this example is held captive relative to the support housing. In particular the upper screw 10 of the respective pair has a circumferential slot 14 into which extends a flange 15 carried on an extension from the outer side of the respective locking dog 9.

Adjacent the enlarged lower end of the activating ring 1 is a support ring 16, which has an inner surface slidingly abutting the tapered surface of the activating ring and an upper surface slidingly abutting the lower face of the locking ring 3. The locking ring has an upper surface which has an oblique outer part 17 slidingly abutting an oblique engagement zone provided by a surface 18 of the support housing 2. The various engagement zones (and particularly the surfaces 6 and 18) have angles relative to the actuating direction of the activating member 1 such that there is a substantial mechanical advantage between the movement of the activating member 1 in the (vertical) activating direction and the vertical movement of the locking member 3, i.e. the upward movement of the activating ring is much greater than the vertical component (in this example downwards) of movement of the locking ring 3. A small movement of the locking ring is sufficient (having regard to the modulus of elasticity of the conductor housing) to produce a sufficient stress on the conductor housing.

Thus upward movement of the activating ring forces the locking ring outwardly. The oblique engagement zone 18 of the datum member (the support housing 2) forces the locking member to have a vertical component of movement, which is in the opposite direction to the movement of the activating member. The support ring 16 acts as a reaction member. It supports the locking ring against the engagement zone 18 of the datum member. It has to accommodate the vertical component of movement of the locking ring 3 and but in doing so it is caused to move laterally by virtue of its engagement with the inclined engagement zone 6 of the activating member. The support ring 16 has a tapered surface 19 which engages, and is preferably at the same angle as, the engagement surface 6 of the activating member.

The combination of the locking ring, the activating member, the support housing (i.e. a datum member) and the support ring allows operation without excessive loading of the locking ring. Moreover, bending or twisting of the locking ring 3 may be avoided by virtue of the support of the locking ring 3 by the support ring 16. In these respects the combination is in itself a potential improvement over the device shown in GB-2393900 and U.S. Pat. No. 7,025,145.

The applied preload is set by latching the activating member relative to the support housing 2. For this purpose the mechanism preferably has at least two serrate latches 20 and 20*a*, each of which is mounted in the support housing. Each latch in this example is in the form of a set of evenly spaced serrations which can engage the serrations of the linear ratchet 7. Each latch has spigots each received in a respective bore 21, 21*a* in the support housing 2 and each latch may be loaded by a spring (not shown) which urges the latch inwards. The latches may be provided at circumferentially spaced intervals and may be discrete or be formed on a respective ring.

Thus the activating ring 1 may be moved in the activating direction, this movement being allowed by the latches, until a desired end position is reached, whereupon at least one of the latches (or sets of latches) engages the ratchet and inhibits substantial reverse movement of the activating member 1.

The multiple latch is designed to work in the general manner as a customary ratchet and latch system in that it provides one directional travel of one component past another.

In an ordinary ratchet and latch system one component (the latch) may be sprung so that it engages discrete positions of the profile of a second component (the ratchet). Movement in the reverse direction is prevented by the locking engagement of the two profiles. The backlash of the system is determined by the pitch of the discrete locking positions of the engagement profile between the two components (the ratchet and the latch). In an ordinary system it is possible for the moving part of the system to come to rest within an infinitesimally small distance from which it can engage with a discrete locking position of the fixed component. From this position there is nothing to prevent a reversal of travel up to the previous discrete locking position witch is approximately one pitch away from the resting position.

It is advantageous to minimize the backlash of the system such that reverse movement is prevented as efficiently as possible. One method for doing this would be to reduce the pitch of the discrete locking positions. However this typically has the unfavorable effect of reducing the perpendicular travel of engaging the ratch-latch, which can present other problems such as (i) reducing the engagement force e.g. in a split ring application; (ii) making the system more expensive to produce and more difficult to inspect; and (iii) making the system more prone to fouling owing to foreign objects obstructing the operation of the ratch-latch.

The described mechanism reduces the backlash of the system while maintaining the original pitch of the discrete locking positions. The two latches 20 and 20*a* in the specific example are positionally out of phase relative to the ratchet. In other words the spacing in the activating direction between a latch tooth on the upper latch and a latch tooth on the lower latch is not an integral multiple of the spacing of the teeth on the ratchet. In the specific example of two distinct latches the phase difference may be 180°, i.e. the spacing or pitch is Y=Z*p+p/2 where p is the pitch of the discrete locking positions and Z is any integer.

More generally the latches 20 and 20*a* (and others) can be identical in design or they may differ; what is important is their positions relative to each other and relative to the ratchet. Any number of latches or sets of latches can be used and the greater the number of latches or sets thereof the smaller the system's backlash. However each subsequent latch provides a diminishing backlash reduction over the previous one, A general formula for determining the pitch of the latches relative to the pitch of the discrete locking positions is as follows:

$$Y=(Z*p)\div(p/n)$$

where Y is the pitch of the latches, p is the pitch of the discrete locking positions, Z is any integer, and n is the number of distinct latches (spaced in the activating direction) employed. In the preferred example, when the top latch is fully engaged in a discrete locking position, the lower latch is exactly halfway between two discrete locking positions. If the top latch had failed to engage, the ratchet could travel in the reverse direction until the lower latch engaged. In this dual latch example the ratchet would be locked after travelling ½ a tooth pitch rather than a whole tooth pitch under a single latch system. If three latches were employed the maximum backlash would be ⅓ the pitch, for four latches it would be ¼, for five latches it would be ⅕, etc.

In the described embodiment the ratchet is carried by the activating member and the latches are carried by the support housing, but a converse arrangement is feasible.

What is claimed is:

1. A ratchet and latch mechanism configured for use in subsea environments, comprising:

first and second members which are relatively moveable in an activating direction, one of the members carrying a ratchet comprising a multiplicity of serrations which have a regular pitch in the activating direction and the other of the members carrying at least two latches which allow the relative movement and can engage the ratchet to inhibit movement reverse to the activating direction, the latches each providing a respective multiplicity of discrete locking positions spaced in the activating direction for the ratchet and being positioned and arranged so that the discrete locking positions provided by one of the latches are positionally out of phase with the discrete locking positions provided by the other latch or latches, wherein each discrete locking position corresponds to a positon of the member that carries the ratchet relative to the member that carries the latch.

2. A mechanism according to claim 1 in which each latch comprises a multiplicity of serrations spaced in the activating direction.

3. A mechanism according to claim 1 in which the pitch between the latches is equivalent to (Z*p)+(p/n), in which p is the pitch of the discrete locking positions, Z is any integer, and n is the number of distinct latches.

4. A device for the application of a preload between a subsea wellhead and a conductor housing, the device comprising:

an activating member, a support housing, a locking member, and a securing structure for securing the support housing relative to the wellhead, the activating member being moveable in an activating direction relative to the support housing, the activating member and the support housing including surfaces which engage the locking member so as to cause, in response to movement of the activating member in the activating direction, an inclined lateral movement of the locking member, said inclined lateral movement having a component parallel to the activating direction which is substantially smaller than the movement of the activating member, wherein one of the activating member and support housing carries a ratchet comprising a multiplicity of serrations which have a regular pitch in the activating direction and the other of the activating member and support housing carries at least two latches which allow the relative movement and can engage the ratchet to inhibit movement reverse to the activating direction, the latches each providing a respective multiplicity of discrete locking positions spaced in the activating direction for the ratchet and being positioned and arranged so that the discrete locking positions provided by one of the latches are positionally out of phase with the discrete locking positions provided by the other latch or latches.

5. A device according to claim 4, in which the ratchet is carried by the activating member and the latches are carried by the support housing.

6. A device according to claim 4, in which each latch comprises a multiplicity of serrations spaced in the activating direction.

7. A device according to claim 4, in which the securing structure comprises a plurality of engagement dogs carried by the support housing and wherein each dog is arranged for advancement through a window in the activating member.

8. A device according to claim 4, further comprising a support member which is positioned to be moved laterally in response to movement of the activating member and to support the locking member against the engagement zone of the datum member.

9. A device according to claim 8, in which the locking member and the support member are laterally expansible rings.

10. A device according to claim 4, in which the activating member and the support housing are annular, the activating member being disposed within the support member and being adapted to receive the wellhead, and the support housing being disposed to land on the conductor housing.

* * * * *